US005184099A

United States Patent [19]

DiMarco et al.

[11] Patent Number: 5,184,099

[45] Date of Patent: Feb. 2, 1993

[54] CIRCUIT BREAKER WITH DUAL MOVABLE CONTACTS

[75] Inventors: Bernard DiMarco, Lilburn; Robert E. Black, Snellville; Stephen D. Cella, Stone Mountain, all of Ga.

[73] Assignee: Siemens Energy & Automation, Inc., Alpharetta, Ga.

[21] Appl. No.: 714,803

[22] Filed: Jun. 13, 1991

[51] Int. Cl.[5] ..... H01N 75/00

[52] U.S. Cl. ..... 335/16; 335/147; 335/195

[58] Field of Search ..... 335/6, 16, 147, 195; 200/144 R, 147 R

[56] References Cited

U.S. PATENT DOCUMENTS 3,469,216 9/1969 Shiraishi ..... 335/147
4,484,164 11/1984 McClellan et al. .
4,513,267 4/1985 McClellan et al. .
4,611,106 9/1986 Pardini et al. ..... 200/149 R
4,611,187 9/1986 Banfi ..... 335/16
4,644,307 2/1987 Tanimoto ..... 335/116
4,791,393 12/1988 Flick et al. .
4,906,967 3/1990 Winter ..... 335/16

*Primary Examiner*—Lincoln Donovan

[57] ABSTRACT

A pivoting lower contact arm arrangement and a circuit breaker including the arrangement. The pivoting lower contact arm arrangement includes a pivoting lower contact arm and a biasing arrangement. The biasing arrangement maintains the contact arm in an operating position with a first force and biases the arm from a blown-open position toward the operating position with a second force. The first force is greater than the second force to provide increased separating speed when the pivoting lower contact arm blows apart from a pivoting upper contact arm of the circuit breaker and moves from its operating position. The biasing arrangement also variously provides magnetic shielding and coupling between the pivoting lower contact arm and other current carrying components of the circuit breaker. The magnetic shielding enhances the blow-apart forces between the pivoting upper contact arm and the pivoting lower contact arm.

12 Claims, 5 Drawing Sheets

CIRCUIT BREAKER WITH DUAL MOVABLE CONTACTS

TECHNOLOGICAL BACKGROUND

The present invention relates to a circuit breaker having dual movable contacts and, more particularly, relates to an arrangement of the dual movable contacts.

BACKGROUND OF THE INVENTION

U.S. Pat. No. 4,791,393, issued to Flick et al. on Dec. 13, 1988, relates to a molded case circuit breaker having a movable upper electrical contact capable of separation from an associated movable lower electrical contact during high level short circuit or fault current conditions. The lower electrical contact is supported by a movable lower contact arm, where the lower contact arm is biased upward by a compression spring. The upper electrical contact is supported by a movable upper elongated contact arm. An operating mechanism moves the elongated contact arm downward to effect engagement of the upper and lower electrical contacts.

Upon the occurrence of a high level short circuit or fault current condition, and as a result of the large magnetic repulsion forces generated by the flow of fault current through the generally parallel contact arms, the upper and lower electrical contacts separate and move from their operating positions to their blown-open positions. In the blown-open position, the lower contact arm is pivoted downward against the upward biasing force of the compression spring. Subsequently, the compression spring returns the contact arm of the lower electric contact to its operating position (see FIG. 3 of the '393 patent). The purpose of providing pivoting upper and lower contact arms is to provide faster and greater separation of upper and lower contacts which better facilitates extinguishing an arc which may occur between the contacts during a high level short circuit or fault current condition.

One problem encountered when using a lower contact arm is the ability to provide a sufficient upward biasing force to maintain the arm in its operating position while also limiting the biasing force to allow downward movement of the arm in a high level short circuit of fault current condition. The biasing force must provide sufficient force between the upper and lower contacts to reduce resistance between these contacts and prevent abnormal heating at the contact interface under normal operating conditions.

The apparatus of the '393 patent uses a compression spring to provide the upward biasing force. Unfortunately, a compression spring is a device which provides a resistance force which increases as its length of deformation increases. Thus, the advantages achieved by providing a lower contact arm are partially defeated in that the compression spring resists downward movement of the lower contact arm with an increasing force as the arm moves downward from its operating position to the blown-open position.

Accordingly, in an arrangement such as that of the '393 patent, the force upwardly biasing the lower contact arm increases as the arm is urged downward, inhibiting the speed and distance at which the contacts can separate for a given short circuit or fault current condition.

Thus, it would be advantageous to provide a lower contact arm arrangement which maintains a high force for biasing the lower contact arm upward when the lower contact arm is in its operating position, and a reduced upward biasing force when the lower contact arm has been moved downward a predetermined amount due to sufficiently high magnetic repulsion forces generated by the flow of current in the upper and lower contact arms.

SUMMARY OF THE INVENTION

The invention provides a circuit breaker contact arm support. The support includes a lower circuit breaker contact arm supported to pivot between a first position and a second position, and an arrangement disposed to apply a first force to the arm while the arm is in the first position and a second force to the arm when the arm is in the second position. The first and second forces urge the arm toward the first position and the first force is greater than the second force.

The invention further provides a circuit breaker. The circuit breaker includes a base, an operating mechanism fastened to the base, a first contact arm coupled to the operating mechanism such that the contact arm is movable between an open position and a closed position, a support fastened to the base, and a second contact arm supported by the support to move between a first position and a second position. The circuit breaker also includes an arrangement disposed to apply a first force to the second contact arm while the second contact arm is in the first position and a second force to the second contact arm when the second contact arm is in the second position. The first and second forces urge the second contact arm toward the first position, the second contact arm engages the first contact arm in the first position when the first force is applied, and the first force is greater than the second force.

The invention further provides a circuit breaker contact arm support. The support includes a lower circuit breaker contact arm including a contact support, and a magnetic shield disposed about the arm. The arm is supported by the support to pivot between a first position and a second position such that an electrical current may flow from the support to the arm, where magnetic fields produced by the current flows in the support and the arm interact with the current flows such that a force is produced to urge the arm to the first position. The shield alters the interaction of the magnetic fields and current flows to reduce the force.

The invention still further provides a circuit breaker including a base, an operating mechanism fastened to the base, a first contact arm coupled to the operating mechanism such that the contact arm is movable between an open position and a closed position, a support fastened to the base, a second contact arm, and a magnetic shield disposed about the arm. The second contact arm is supported by the support to pivot between a first position and a second position such that electrical current may flow in the support and the arms when the first contact arm is in the closed position and the second contact arm is in the first position. Magnetic fields are produced by the current flows in the support and the second contact arm, and interact with the current flows to produce forces which urge the second contact arm to the first position. The shield alters the interaction of the magnetic fields and current flows to reduce the forces.

BRIEF DESCRIPTION OF THE DRAWINGS

An embodiment of the invention will hereinafter be described in conjunction with the drawings, wherein like designations denote like elements, and.

DETAILED DESCRIPTION OF THE PREFERRED EMBODIMENT

Figure 1:
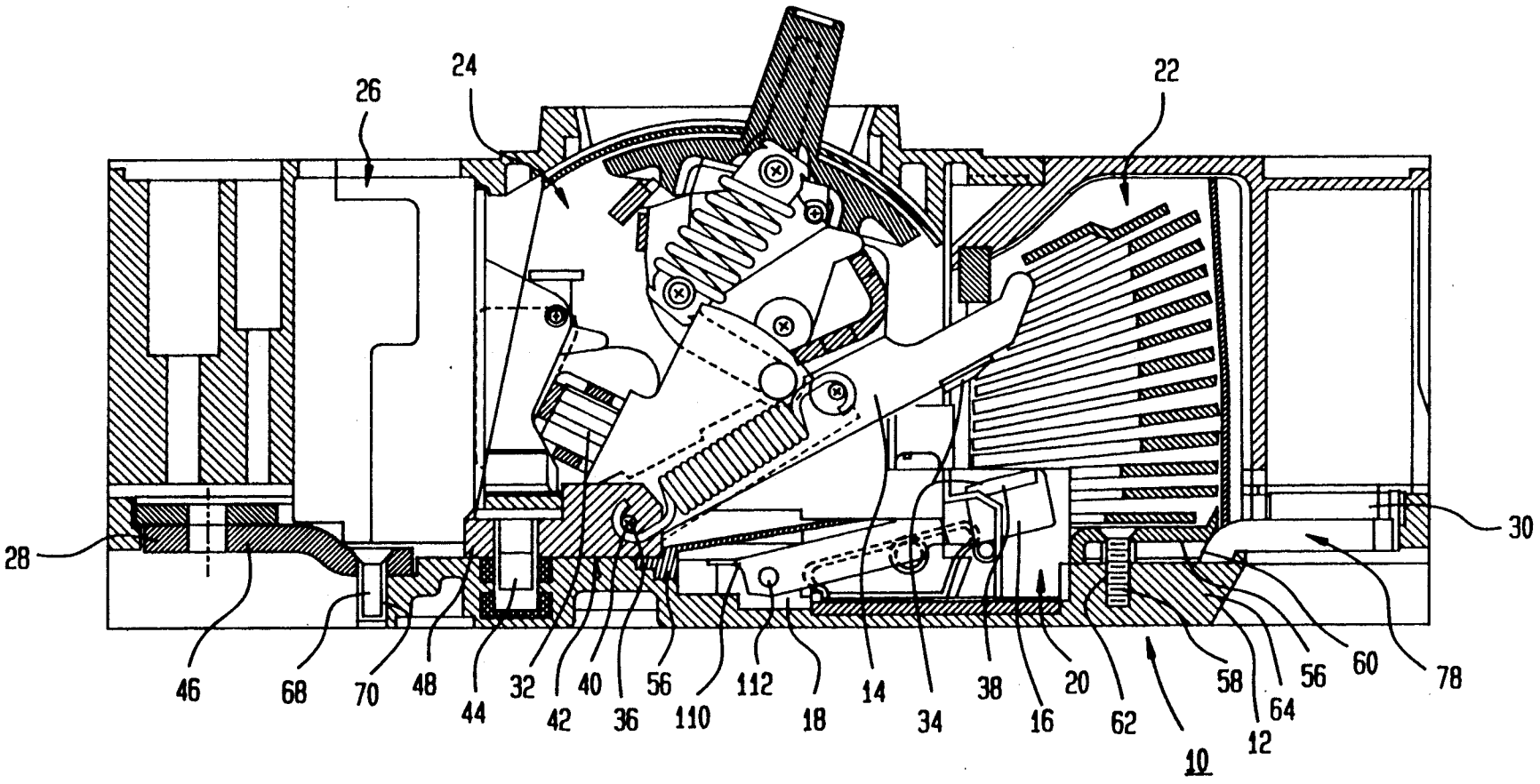
FIG. 1 is a lengthwise sectional view of a molded case circuit breaker according to the invention.

Referring to FIG. 1, a circuit breaker 10 according to one aspect of the invention includes an insulating plastic support base 12. The main components of circuit breaker 10 are pivoting (movable) upper contact arms 14, pivoting (movable) lower contact arms 16, lower contact arm supports 18, biasing arrangements 20, arc chambers 22, an upper pivoting contact arm operating mechanism 24, an electronic or thermal magnetic trip unit 26, load terminals 28, and line terminals 30. Circuit breaker 10 is a three-phase circuit breaker having one arm 14, arm 16, support 18, arrangement 20, terminal 28, and terminal 30 for each of the three phases. Components 12, 14, 22, 24, 26, 28 and 30 are of conventional design, e.g. Siemens Model No. LD63B600. One operating mechanism 24 and trip unit 26 are provided to move a single insulative cross-bar 32, which moves each of the three arms 14 (see FIG. 2) in unison. For purposes of clarity, the following description will only reference the components of one phase of circuit breaker 10, but it should be understood that it is applicable to each or all of the three phases.

Contact arm 14 has a conventional electrical contact 34 brazed or otherwise fastened to a first end and a pivot hole 36 at its second end. Electrical contact 34 engages and disengages an electrical contact 38 at the end of contact arm 16. A pivot pin 40, mounted in pivot hole 36, pivotally attaches contact arm 14 to a terminal strap 42. Strap 42 is fastened to base 12 by any suitable means, such as a screw 44, and is coupled to load terminal 28 by trip unit 26. Trip unit 26 is fastened, and electrically connected, to mount 46 of load terminal 28 and mount 48 of strap 42.

Operating mechanism 24 moves cross-bar 32 and contact arms 14 between closed and open positions such that electrical contacts 34 and 38 can be engaged and disengaged, respectively. Occurrence of a fault current in one of the three phases will cause contact arm 14 to pivot counterclockwise (as viewed in FIG. 1) about pin 40 to separate contacts 34 and 38. When trip unit 26 detects an unacceptable current level in one of the three phases, it actuates operating mechanism 24 in a conventional manner so that mechanism 24 rotates contact arm 14 counterclockwise about pin 40 to separate contacts 34 and 38.

Figure 2:
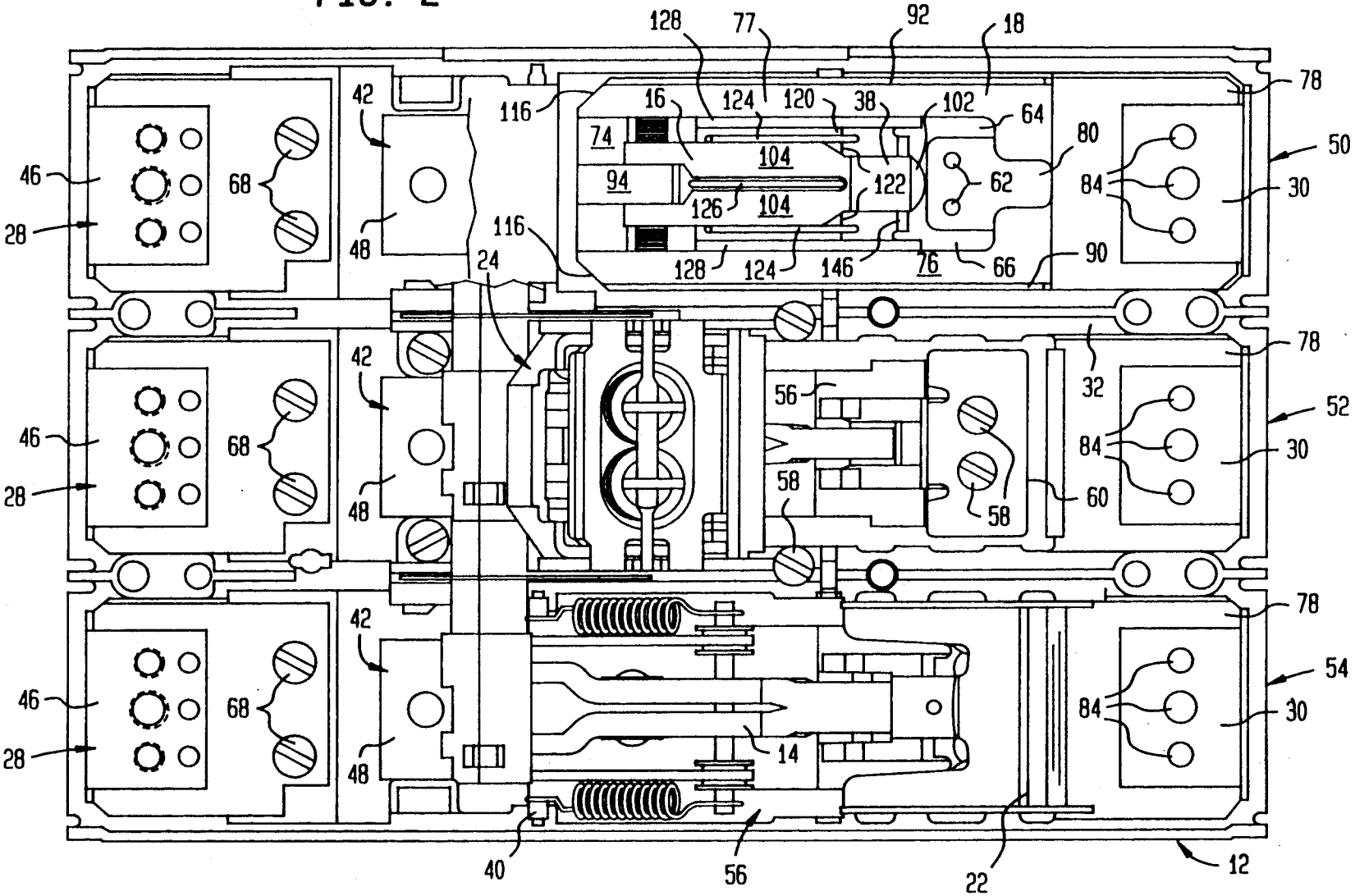
FIG. 2 is a top plan view of a circuit breaker base shown in FIG. 1 having various components of the circuit breaker removed to reveal the details of the circuit breaker base.

Referring to FIG. 2, the arrangement of base 12, load terminals 28, line terminals 30, contact arm supports 18, and contact arm 16 are illustrated. In FIG. 2, various components of circuit breaker 10 are removed from base 12 such that: support 18 of phase 50 can be seen without obstruction; operating mechanism 24 is shown above phase 52; and contact arm 14 and arc chamber 22 are shown above phase 54. Each contact arm support 18 is formed integrally with line terminal 30 and, as illustrated in FIGS. 1 and 2, is partially covered by an arc insulator 56. Insulator 56 is fastened above contact arm support 18 with two screws 58 and an arc runner 60. Screws 58 and arc runner 60 also serve to fasten support 18 to base 12. More specifically, screws 58 engage a pair of threaded holes 62 within a boss 64 of base 12. Boss 64 rests within an opening 66 of support 18. With this arrangement, support 18 is held against base 12, and arc insulator 56 is fastened between support 18 and arc runner 60, as illustrated in FIG. 1 and phase 52 of FIG. 2.

Referring again to FIGS. 1 and 2, load terminals 28 are fastened to base 12 by screws 68 engaging threaded holes 70 in base 12. Base 12 also includes two phase dividers 72 which are integrally formed with base 12 to divide phases 50, 52 and 54. Dividers 72 inhibit arcing between respective phases. By way of example only, base 12, dividers 72 and arc insulator 56 may be molded from a thermoset plastic.

Load terminals 28 provide locations for electrically coupling a three-phase apparatus or distribution system to circuit breaker 10. Line terminals 30 provide corresponding locations for electrically coupling a three-phase power source to circuit breaker 10. Accordingly, when contacts 34 and 38 for each phase are engaged, power is transmitted from the three-phase power source to the three-phase device or power distribution system. Load and line terminals 28 and 30 may include any suitable attachment means for allowing wires or other conductors to be secured thereto, such as a pair of threaded holes 84 which receive screws for fastening one terminal block (not shown) to each of terminals 28, 30. Of course, depending upon the application, the terminal block may be replaced with other appropriate arrangements for coupling conductors to terminals 28, 30.

Figure 3C:
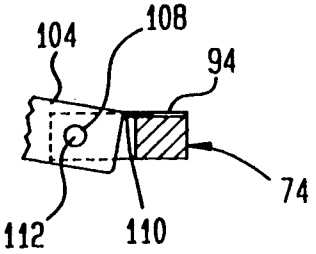
FIG. 3C is a partial sectional view of an end portion of the lower contact arm support and the associated pivoting lower contact arm.
Figure 3A:
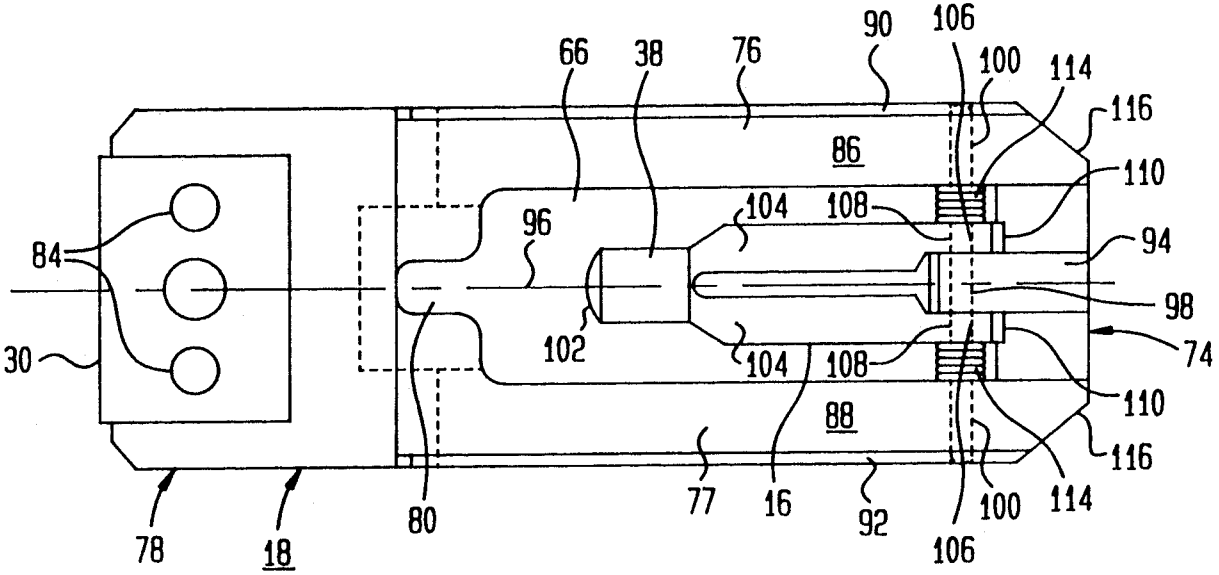
FIG. 3A is a top plan view of a lower contact arm support and an associated pivoting lower contact arm.
Figure 3B:
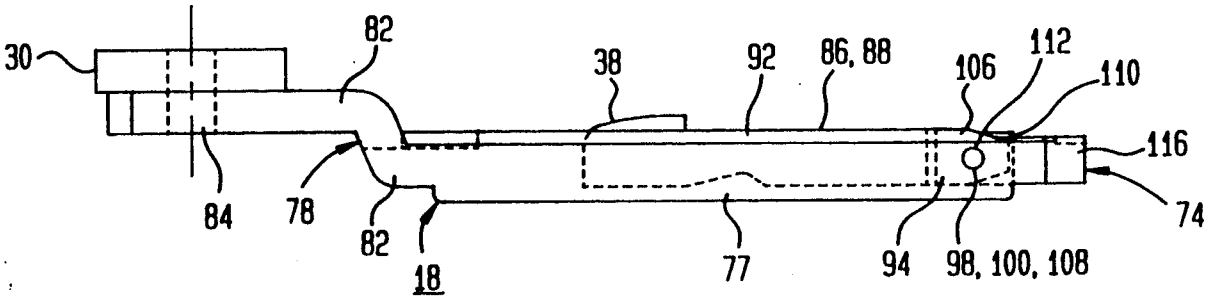
FIG. 3B is a side view of the lower contact arm support and the associated pivoting lower contact arm.

Referring to FIGS. 3A and 3B, pivoting lower contact arm support 18 may be fabricated from an elongated, unitary plate of conductive metal, such as copper which is silver plated, or from separate components secured together in an appropriate manner. Support 18 includes a first, generally rectangular end portion 78 supporting line terminal 30, and a second generally rectangular end portion 74 from which lower contact arm 16 is pivotably supported. Line terminal 30 is pivoting electrically and mechanically coupled to rectangular end portion 74 by a pair of spaced, parallel conductive side members 76 and 77 such that a substantially rectangular hole 66 including an end protruding opening is circumscribed by terminal 30, rectangular end portion 74, and members 76 and 77.

Referring to FIG. 3B, first end portion 78 is bent as shown at 82 such that the top surface of terminal 30 is raised above the top surfaces of members 76 and 77, and the top surface of end portion 74. Members 76 and 77 each have a rectangular cross section suitable for the intended current density. Members 76 and 77 have flat, coplanar upper surfaces 86 and 88, respectively. Each surface 86, 88 has an associated lengthwise groove 90, 92 at the outside edge thereof to facilitate the positioning of arc insulator 56.

Rectangular end portion 74 includes a central pivot support 94. Pivot support 94 has a substantially rectangular cross section, is parallel with members 76 and 77, and extends toward end portion 78 along a center line 96 which is substantially equidistant between members 76 and 77. Pivot support 94 includes a pivot hole 98 which is concentric with a pair of pivot holes 100 in members 76 and 77. The ends of members 76 and 77 which terminate at end portion 74 may include truncated corners 116 to better define a current path to avoid undesirable eddy currents within portion 74.

Lower pivoting contact arm 16 includes a contact carrying portion 102 and a pair of beam members 104 extending therefrom. Contact 38 is brazed or otherwise fastened to the top surface of portion 102. Members 104 have a substantially rectangular cross section and extend from portion 102 such that they are parallel. Each member 104 includes a pivot portion 106, at its end remote from portion 102, with a pivot opening 108 and a contact tip 110.

Referring to FIG. 3C, a partial sectional view of end portion 74, member 104 and contact tips 110 are shown in greater detail. When contact arm 16 is biased upwardly, contact tips 110 of members 104 mechanically and electrically engage end portion 74. This engagement provides a limit to the upward movement of contact arm 16 and a pair of current paths from contact arm 16 to end portion 74.

When contact arm 16 is assembled with contact arm support 18, a pivot pin 112 pivotally supports it relative to pivot support 94. A pair of compression springs 114 are positioned about pivot pin 112 with one compression spring 114 interposed between side member 76 and the adjacent member 104, and the other spring 114 interposed between side member 77 and the other member 104. Compression springs 114 serve to force pivot portions 106 inwardly toward and against central pivot support 94. This arrangement produces a contact force between portions 106 and support 94 which increases the current carrying capacity of the interface between members 104 and support 94.

When arm 16 is biased upwardly by biasing arrangement 20, and current is flowing through circuit breaker 10, current will flow from contact arm support 18 to contact arm 16 via a number of contact locations. These contact locations include the locations of engagement between portions 106 and support 94, tips 110 and portion 74, pin 112 and portions 106, and pin 112 and support 94.

Figure 4A:
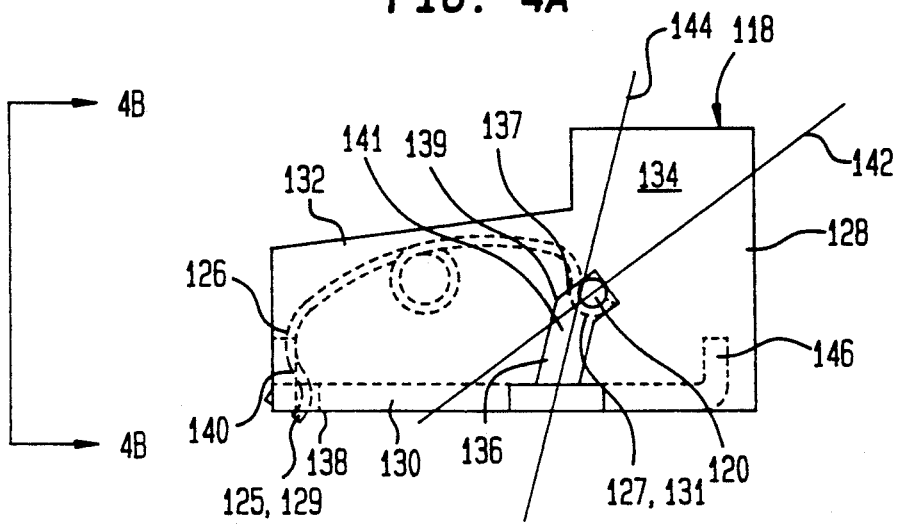
FIG. 4A is a side view of an arrangement for biasing the pivoting lower contact arm upwardly.
Figure 4B:
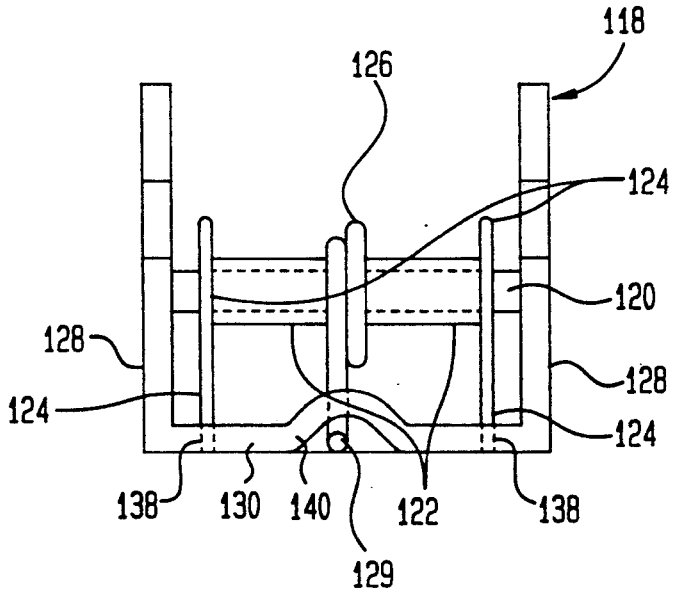
FIG. 4B is an end view, taken along line 4B—4B in FIG. 4A, of the arrangement for biasing the lower contact arm upwardly.

FIGS. 4A and 4B show the details of biasing arrangement 20. Arrangement 20 includes a U-shaped housing 118, a roller pin 120, rollers 122, side springs 124, and a central spring 126. Arrangement 20 biases contact arm 16 toward its operating position with two levels of force. The first force is greater than the second force and holds contact arm 16 in its operating position (FIGS. 5A and 5C) against the downward force applied from contact arm 14 to arm 16. The second force allows arm 16, after moving a predefined distance from its operating position, to move downward with reduced force when arms 14 and 16 blow apart (FIG. 5B). U-shaped housing 118 magnetically affects arms 14 and 16 to allow arms 14 and 16 to blow apart more swiftly and to delay the return of arm 16 to its operating position while an arc between arms 14 and 16 is being extinguished.

U-shaped housing 118 is preferably fabricated from a single piece of sheet steel and includes a pair of sides 128 extending upwardly from a base 130. Sides 128 are fabricated to include an angled portion 132 and rectangular portion 134. Portions 132 and 134 enqaqe recesses (not shown) in arc insulator 56 such that when circuit breaker 10 is assembled, biasing arrangement 20 is located below, and shielded by, arc insulator 56. Sides 128 also include opposed dual-angle slots 136. Base member 130 extends between side supports 128 to provide the U-shape of support 118 and supports 128 in a parallel spaced and side-by-side relationship. Base 130 includes a pair of side engagement holes 138 and a central engagement tab 140. Base member 130 includes an upward extending stop tab 146 which limits the downward movement of contact arm 16.

When all of the components of biasing arrangement 20 are assembled, rollers 122 are rotatably mounted upon roller pin 120, and the ends of roller pin 120 are received in the opposing slots 136. End hook portions 125 of springs 124 engage respective engagement holes 138, while second hook portions 127 of springs 124 engage roller pin 120 adjacent sides 128 and rollers 122, such that roller pin 120 is biased toward the top portion of slot 136. Central spring 126 also assists in urging roller pin 120 to this location. More specifically, a lower hook portion 129 of spring 126 engages engagement tab 140 while an upper hook portion 131 of spring 126 engages pin 120 between rollers 122. The upper portion 137 of slot 136 permits movement of pin 120 along a line 142 until pin 120 passes an intermediate position 139 and enters a lower portion 141 of slot 136. The lower portion of slot 136 permits movement of pin 120 along line 144. The arrangement of springs 124 and 126 allow pin 120 to remain substantially perpendicular to sides 128 during any such movement.

By way of example only, springs 124 and 126 may be fabricated using a wire form technology, such that a first downward force of 23 pounds is required to overcome the first upward force of springs 124 and 126, and allow pin 120 to move downward along line 142, and a second downward force of 5 pounds is required to overcome the second upward force, lower than the first upward force of springs 124 and 126, and allow pin 120 to move downward along line 144. Spring 124 may, for example, be formed with a 19 gauge wire and spring 126 may be formed with a 25 gauge wire having a single central coil 145. By way of further example, for the illustrated embodiment line 142 is at an acute angle from base 130 in the range of 25°–40° and line 144 is at an acute angle from base 130 in the range of 70–85°.

Turning now to the arrangement of pivoting upper and lower contact arms 14 and 16, and biasing arrangement 20; phase 50 of FIG. 2 illustrates the positioning of biasing arrangement 20 with respect to members 104 of arm 16 and side members 76 and 77. More specifically, one side 128 is interposed between member 76 and respective beam 104, and the other side 128 is interposed between member 76 and the proximate beam 104. Each spring 124 is interposed between one side 128 and one beam 104. Spring 126 is interposed between beams 104 and lies substantially along the center line of contact arm 16.

Figure 5A:
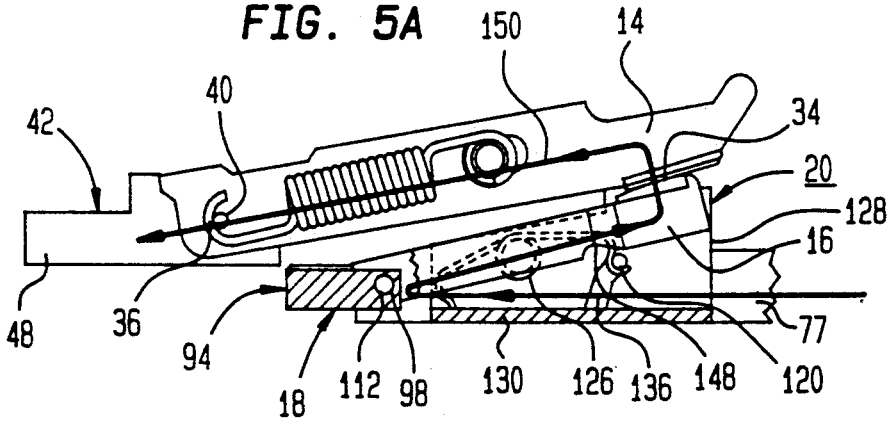
FIG. 5A is a side view of the upper contact arm and lower contact arm, where the contacts supported by these arms are electrically engaged, and the arrangement for biasing is biasing the lower contact arm in its operating position.
Figure 5B:
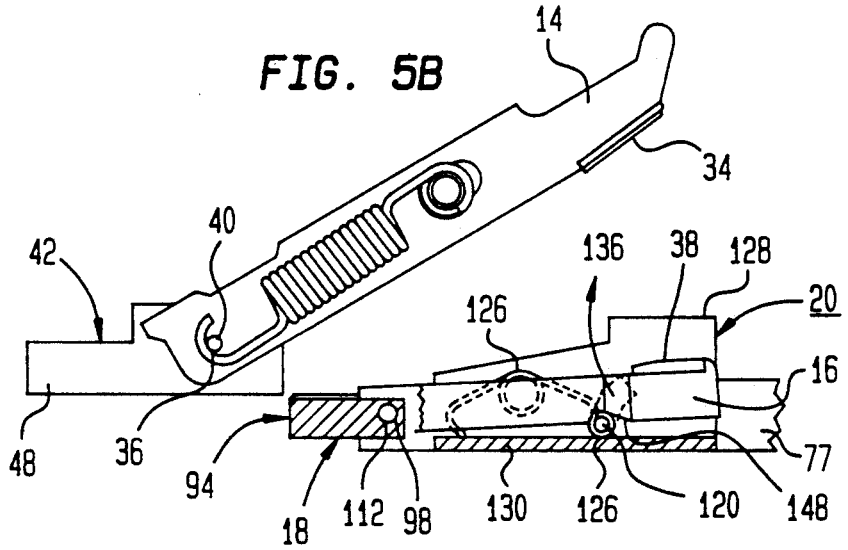
FIG. 5B is a side view of a pivoting upper contact arm and the lower contact arm arranged relative to the arrangement for biasing upwardly, where the lower contact arm is shown in a blown-open position.
Figure 5C:
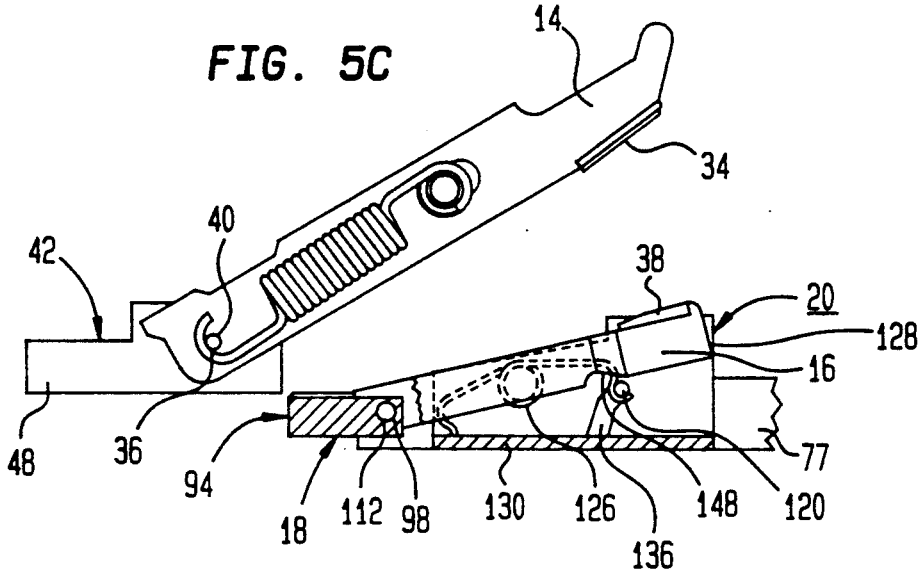
FIG. 5C is a side view of the upper contact arm and lower contact arm, where the upper contact arm is in its open position and the lower contact arm is biased by the arrangement for biasing in its operating position.

Referring to FIGS. 5A, 5B, and 5C, the operational interaction between upper contact arm 14, lower contact arm 16, and biasing arrangement 20 is illustrated. For purposes of clarity, rollers 122 and tab 146 are not illustrated in FIGS. 5A-5C. Referring to FIG. 5A, arm 14 is in its closed position, and arm 16 is in its operating position, contacts 34 and 38 being electrically engaged. In its operating position, arm 16 is urged upwardly by a first upward force applied by biasing arrangement 20 via roller pin 120 and rollers 122. Rollers 122 apply the first upward force to lower roller surfaces 148 of arm 16. When contacts 34 and 38 are engaged, one current path through circuit breaker 10 substantially follows the path shown by the arrow 150. Current flowing from terminal 30 is divided and flows through members 76 and 77, where the direction of the main components of the current are substantially parallel. In end portion 74, the current in members 76 and 77 are combined and are directed into contact arm 16 via the contact locations between arm 16, end portion 74, and support 94, as discussed above. The main component of current in central breaker 54 is substantially parallel to the central axis of arm 16 until the current passes from arm 16 to arm 14 via contacts 34 and 38, Where the main component of current in arm 14 is substantially parallel to its central axis.

Currents which have current flow components which are parallel and in opposite directions repel each other, whereas currents which have parallel components and which flow in the same direction attract each other. This phenomenon is a result of the magnetic fields produced by the currents and the interaction of these magnetic fields with the currents. The magnitude of the repulsion or attraction is affected by the distance between the respective parallel components of the currents, and magnetic shielding which may be provided between the currents. Accordingly, when there is current flow from contact arm 16 to contact arm 14, contact arms 14 and 16 will repel each other due to the repulsive forces ("blow-off forces") produced by the parallel components of current in arms 14 and 16.

When the current flow in arms 14 and 16 is sufficiently high, and hence the blow-off forces are sufficiently high, arms 14 and 16 will assume the positions illustrated in FIG. 5B. During the period in which arms 14 and 16 move to these positions, an arc occurring between contacts 34 and 38 is stretched, extinguished and moved toward arc chamber 22. To move to its blown-open position, arm 16 must be repelled from arm 14 with sufficient force to overcome the first and second upward forces produced by biasing arrangement 20. The first upward force is higher than the second upward force since the contact pressure between contacts 34 and 38 must be sufficient to avoid heating between contact when the circuit breaker is carrying its rated current. During normal operation, the first upward force is high enough to rigidly maintain lower contact arm 16 in its operating position. In the event that the current flowing through arms 14 and 16 reaches a level high enough to blow arms 14 and 16 apart, it is advantageous to provide a reduced upward force upon arm 16 after arm 16 has moved downward from its operating position and past the intermediate position. The reduced second upward force allows the arm 16 to move downward at an increased rate to assist in attenuating an arc which may occur between contacts 34 and 38. By providing a dual biasing force to arm 16 with arrangement 20, it is possible to achieve much higher interrupting ratings and lower let-thru energy in a cost-effective manner. Of course, arrangement 20 may be modified to provide a range or gradation of biasing forces.

The second upward force is sufficient to return arm 16 to its operating position as illustrated in FIGS. 5A and 5B. FIG. 5C illustrates the arm 14 in its open position and arm 16 in its operating position subsequent to the arms being blown apart. To reset circuit breaker 10 and engage contacts 34 and 36, operating mechanism 24 is manually operated in a conventional manner.

In addition to the blow-off forces which occur between contact arms 14 and 16, repulsive forces occur between arm 16 and members 76 and 77 due to the interaction of the opposite and parallel components of current in these components. Accordingly, while the blow-off forces between arms 14 and 16 tend to pivot arm 16 downward, the repulsive forces between arm 16 and members 76 and 77 tend to force arm 16 upwardly. This force resists and slows the downward pivoting motion of arm 16 when arms 14 and 16 should be blowing apart to extinguish an arc. As discussed above, sides 128 are interposed between members 76 and 77 and contact arm 16. By interposing these sides in this manner, U-shaped support 118 is disposed about arm 16 such that it provides a magnetic shield between arm 16 and members 76 and 77. By providing shielding, repulsive forces between arm 16 and members 76 and 77 are reduced, thereby allowing arms 14 and 16 to blow apart with increased speed. The magnetic shielding provided by U-shaped support 118 also serves to increase the repulsive forces between arms 14 and 16 for a given current. Additionally, magnetic shielding also reduces the attractive forces between arm 14 and members 76 and 77 which tend to slow the separation of arms 14 and 16 during blow-apart. The attractive forces between arm 14 and members 76 and 77 are produced by the parallel components of current in arms 14 and members 76 and 77 which are in the same direction.

U-shaped support 118 also affects the ability of the second upward force of biasing arrangement 20 to return arm 16 to its operating position. More specifically, the magnetic coupling of support 118 to arm 16, combined with the second upward force (reduced relative to the first upward force) help to increase the opening speed and delay movement of arm 16 to its operating position until the current flow Via an arc has decreased or stopped. This delay assists in preventing initiating a second arc between contacts 34 and 38 after the original arc is extinguished.

The preferred embodiment of the present invention has been disclosed by way of example and it will be understood that other modifications may occur to those skilled in the art without departing from the scope and spirit of the appended claims.

What is claimed is:

1. In a circuit breaker of the type including a first circuit breaker contact arm mechanically coupled to an operating mechanism, a circuit breaker contact arm support comprising:

a support;

a second circuit breaker contact arm supported by the support to pivot between a first position and a second position, the second circuit breaker contact arm being engageable with the first circuit breaker contact arm substantially at the first position; and an arrangement disposed to apply a first force to the second circuit breaker contact arm while the second circuit breaker contact arm is in the first position and a second force to the second circuit breaker contact arm when the second circuit breaker contact arm is in the second position;

where the first and second forces urge the second circuit breaker contact arm toward the first position and the first force is greater than the second force.

2. The support of claim 1, where an intermediate position is provided between the first and second positions, the first force is applied to the second circuit breaker contact arm between the first and intermediate positions, and the second force is applied to the second circuit breaker contact arm between the second and intermediate positions.

3. The support of claim 1, where the arrangement comprises:

first and second sides including opposed slots having a first portion and a second portion, the sides being arranged in a parallel and spaced apart relationship;

a pin disposed to apply the first and second forces to the second circuit breaker contact arm, the pin having a first end and a second end where the first end is disposed within the slot of the first side and the second end is disposed within the slot of the second side; and at least one spring arranged to urge the pin into the first portion.

4. The support of claim 3, wherein the second circuit breaker contact arm comprises a pair of parallel members each including a lower roller surface, and the arrangement includes a pair of rollers rotatably mounted on the pin such that the first and second forces are transmitted from the rollers to the lower roller surfaces.

5. The support of claim 1, where the second circuit breaker contact arm includes a contact tip arranged to engage the support when the second circuit breaker contact arm is in the first position to limit the movement of the second circuit breaker contact arm and provide a current path from the support to the second circuit breaker contact arm.

6. A circuit breaker comprising:

a base;

an operating mechanism fastened to the base;

a first contact arm coupled to the operating mechanism such that the contact arm is movable between an open position and a closed position;

a support fastened to the base;

a second contact arm supported by the support to move between a first position and a second position; and an arrangement disposed to apply a first force to the second contact arm while the second contact arm is in the first position and a second force to the second contact arm when the second contact arm is in the second position;

where the first and second forces urge the second contact arm toward the first position, the second contact arm engages the first contact arm in the first position when the first force is applied, and the first force is greater than the second force.

7. The circuit breaker of claim 6, further comprising a load terminal and a line terminal, where the first contact arm is coupled to the load terminal, and the second contact arm is coupled to the line terminal such that electrical current may flow from the line terminal to the load terminal when the contact arms are engaged.

8. The circuit breaker of claim 6, where the first contact arm includes a first electrical contact and the second contact arm includes a second electrical contact disposed to engage the first electrical contact.

9. The support of claim 6, where an intermediate position is provided between the first and second positions, the first force is applied to the arm between the first and intermediate positions, and the second force is applied to the arm between the second and intermediate positions.

10. The support of claim 6, where the arrangement comprises:

first and second sides including opposed slots having a first portion and a second portion, the sides being arranged in a parallel and spaced apart relationship;

a pin disposed to apply the first and second forces to the arm, the pin having a first end and a second end where the first end is disposed within the slot of the first side and the second end is disposed within the slot of the second side;

at least one spring arranged to urge the pin into the first portions such that the first force is applied to the arm when the pin is in the first portions and the second force is applied to the arm when the pin is in the second portion.

11. The support of claim 10, where the arm comprises a pair of parallel members each including a lower roller surface, and the arrangement includes a pair of rollers rotatably supported by the pin such that the first and second forces are transmitted from the rollers to the lower roller surfaces.

12. The support of claim 6, where the second contact arm includes a contact tip arranged to engage the support when the second contact arm is in the first position to limit the movement of the second contact arm and provide a current path from the support to the second contact arm.

* * * * *